US005927122A

United States Patent [19]

Höffgen et al.

[11] Patent Number: 5,927,122

[45] Date of Patent: Jul. 27, 1999

[54] DEVICE FOR GUIDING A HOLLOW BLANK

[75] Inventors: Walter Höffgen, Korschenbroich; Norbert Theelen, Mönchengladbach; Manfred Peglau, Duisburg, all of Germany

[73] Assignee: Mannesmann Aktiengesellschaft, Dusseldorf, Germany

[21] Appl. No.: 09/046,952

[22] Filed: Mar. 24, 1998

[30] Foreign Application Priority Data

Mar. 24, 1997 [DE] Germany ..... 197 14 300

[51] Int. Cl.[6] ..... B21B 19/06

[52] U.S. Cl. ..... 72/100; 72/95

[58] Field of Search ..... 72/95, 96, 97, 72/100, 428

[56] References Cited

U.S. PATENT DOCUMENTS 1,882,655 10/1932 Clark ..... 72/96

3,348,399 10/1967 Prieur ..... 72/97

FOREIGN PATENT DOCUMENTS 38 33 375 5/1989 Germany .

*Primary Examiner*—Lowell A. Larson

*Attorney, Agent, or Firm*—Cohen, Pontani, Lieberman & Pavane

[57] ABSTRACT

A device for guiding a rotating hollow blank emerging from a cross-rolling mill, especially an Assel mill, which device includes at least two tubular guide rollers that extend over the length of the hollow blank and are arranged next to each other below the delivery plane and parallel to the delivery direction of the hollow blank. The guide rollers are supported by support rollers arranged below the guide rollers. The speed of the guide rollers and the support rollers is synchronized with the delivery speed of the hollow blank. The guide rollers are adjustably mounted on inclined guide blocks. A plurality of upper guide rollers are pivotably mounted so as to be able to contact the outer surface of the hollow blank. Disk type rollers are arranged between the guide rollers to lift the hollow blank away from the guide rollers for ejection from the cross-rolling mill.

15 Claims, 1 Drawing Sheet

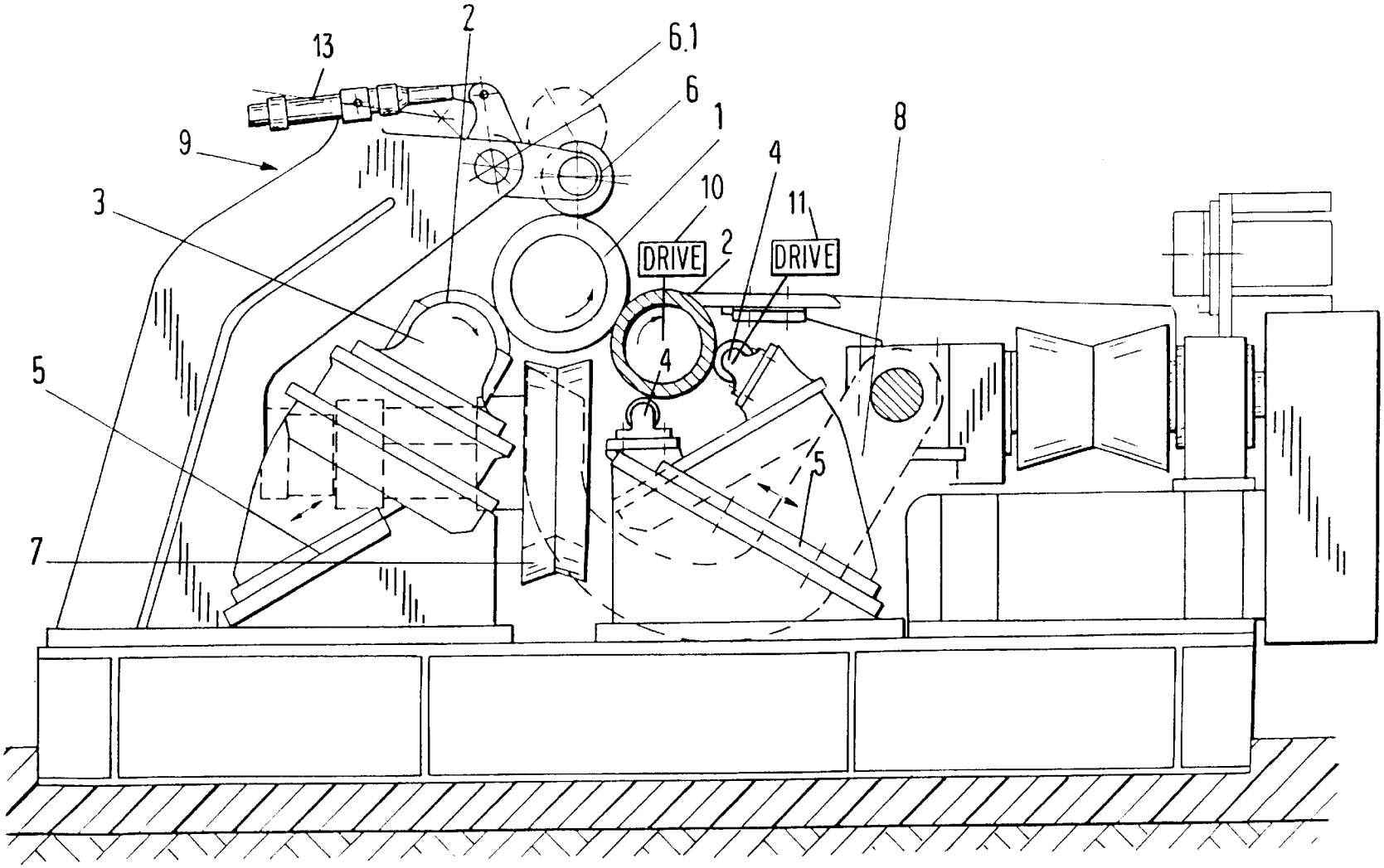
DRIVE
DRIVE
1
2
2
3
4
4
5
5
6
6.1
7
8
9
10
11
13

DEVICE FOR GUIDING A HOLLOW BLANK

BACKGROUND OF THE INVENTION

1. Field of the Invention

The present invention relates to a device for guiding a hollow blank emerging from a cross-rolling mill and in particular, an Assel mill, wherein the hollow blank is rotated about a longitudinal axis.

2. Description of the Related Art

A hollow blank rolled in a cross-rolling mill, especially an Assel mill, emerges from the rolling mill at a certain speed while rotating about its own axis. The movement of the hollow blank during the delivery stage of the rolling process must be controlled or supported by suitable guides until, upon termination of the rolling process, the blank is transported to the next roller table. In the prior art, a number of fairly expensive proposals for the delivery guides have been made, some of which have been functionally implemented and demonstrated.

The known delivery guides are inadequate, however, especially in machines that roll hollow blanks with extremely large d/s ratios (for example, d/s=50), because at high temperatures thin-walled blanks transmit only very small bending and torsion moments. If during delivery a hot hollow blank impacts even small edges, or if its forward motion is otherwise hindered, e.g., by diameter fluctuations in the hollow blank, then vibrations or blockages quickly arise, and the hollow blank warps in a wave-like manner. This leads to vibrations, which can be so strong that the rolling process must be broken off.

Even in relatively smooth rolling processes, the friction force to be overcome increases along with the rolled length, and thus the mass, of the hollow blank. Under some circumstances, if the rotational movement of the hollow blank during delivery is not supported by suitable components, the friction force to be overcome by the dead weight can become so great that the transmittable torsion moment is exceeded and the hollow blank is twisted.

A further disadvantage of the known prior art is that unclean guides in the entry and delivery sections of a rolling mill negatively effect tolerances and thus impair quality.

SUMMARY OF THE PRESENT INVENTION

The object of the present invention is to provide a reliable device for continuously guiding a hollow blank emerging from a cross-rolling mill, and in particular, a device that avoids impact and warping, reduces torsional stress and, to a great extent, eliminates oscillations and vibrations.

Pursuant to this object, the guiding device of the present invention includes at least two tubular guide rollers, arranged next to each other and extending over the maximum length of the hollow blank. The guide rollers are arranged below the delivery plane, parallel to the delivery direction of the hollow blank, and are mounted so as to be rotatable about the longitudinal axis.

The present invention thus provides a continuous, rotating tubular guide for the hollow blank, ensuring that a rotating hollow blank emerging from the rolling mill exits the rolling mill as unhindered as possible while being optimally guided. The continuous guide rollers easily absorb fluctuations in the diameter of the emerging hollow blank; and in the case of long thin-walled hollow blanks, twisting is reliably avoided.

In one embodiment of the present invention each of the tubular guide rollers is mounted on its front end, as is the case, for example, in roller cooling banks.

According to another embodiment of the invention, the guide rollers are supported at intervals by rotatably-mounted support rollers arranged below the guide rollers, so as is to prevent the tubular guide rollers from bending.

Disadvantageously, in the prior art the rotating hollow blank induces rotation of the freely rotating guide rollers especially in the case of a long thin-walled hollow blank, whereby roll resistance acts as a hindrance. According to the present invention, however, the tubular guide rollers, and/or the support rollers, are rotary driven by drives synchronized with the hollow blank delivery speed. As a result, torsional forces acting on the hollow blank are avoided.

In another embodiment of the present invention, two tubular guide rollers are arranged below the hollow blank on both sides so as to be offset by approximately 30° relative to the horizontal delivery plane. In this arrangement, the hollow blank rests evenly on both guide rollers and is supported by the guide rollers during delivery.

According to yet another embodiment of the present invention, the guide rollers are adjustably mounted on inclined guide blocks slidably mounted to a frame and arranged symmetrically relative to the roll center so as to adjust the position of the tubular guide rollers to accommodate different hollow blank dimensions. By moving the guide rollers on these guide blocks, it is possible to change the vertical setting and, at the same time, the spacing of the guide rollers from each other. As a result, even hollow blanks of very different diameters are reliably guided.

Especially in an arrangement having only two tubular guide rollers, it is advantageous when, according to another embodiment of the present invention, several upper guide rollers are arranged vertically above the hollow blank. The upper guide rollers can either be positioned to contact the outer surface of the hollow blank or to be jointly pivoted away for ejection of the hollow blank. The upper guide rollers prevent a lateral break-out of the emerging hollow blank from the support of the tubular guide rollers.

Pursuant to a further embodiment of the present invention, liftable and lowerable disk-type rollers having circumferential grooves are rotatably driven around a horizontal axis that runs at a right angle to the hollow blank delivery direction. The disk-type rollers are arranged between the two lower tubular guide rollers so as to transport away the finish-rolled hollow blank. Once the upper short guide rollers have been pivoted away, the disk-type rollers are pivoted in from below. The disk-type rollers lift the hollow blank away from the tubular guide rollers and transport the hollow blank on the circumferential grooves, in a manner known to those skilled in the art, to the position at which the blank is turned over to a transport device. The finish-rolled hollow blank is then ejected, in a known manner, for example, via a pivoted lever.

The present invention therefore provides an optimal guiding device for rotating hollow blanks emerging from a cross-rolling mill and is especially advantageous for use with thin-walled hollow blanks. In the case of thin-walled hollow blanks, the twisting danger associated with conventional hollow blank guides is reliably avoided, the use of the continuous guide eliminating the danger that the hollow blank will buckle.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The single drawing shows a cross-section through a hollow blank guiding device according to one embodiment of the present invention.

DETAILED DESCRIPTION OF THE PREFERRED EMBODIMENTS

As is shown in the drawing, a rotating hollow blank 1, emerging from a cross-rolling mill, is guided by two lower guide rollers 2, being arranged offset by approximately 30° relative to the horizontal delivery plane. The guide rollers 2 extend over the maximum length of the hollow blank 1 to be rolled (e.g., 15 m), and are configured as continuous guide tubes. Radial bearings 3 are located on the front ends of the rotatable tubular guide rollers 2. Lower support rollers 4 are arranged at suitable intervals to support the guide rollers 2. The tubular guide rollers 2 are driven by a first drive means 10 synchronized with the delivery speed of the hollow blank 1. The lower support rollers 4 are driven by a second drive means 11 synchronized with the delivery speed of the hollow blank 1. The dimension-dependent adjustment of the tubular guide rollers 2 is carried out centrally relative to the roll center and on an individual basis by means of suitably inclined guide blocks 5 slidably mounted to a frame 9. In the case of smaller diameter differences, adjustment is accomplished by jointly pivoting the rollers 2 about an externally arranged rotational point. Multiple short upper guide rollers 6 are rotatably mounted to a lever arm 12, the upper guide rollers 6 being arranged in the longitudinal direction of the blank 1 so as to prevent a lateral break-out of the emerging hollow blank 1.

After the end of rolling, a piston 13 urges one end of the lever arm 12 so as to pivot the upper guide rollers 6 away from the hollow blank 1 to the position shown at 6.1. Driven disk-type rollers 7 are arranged between the tubular guide rollers 2, and are pivoted in for longitudinally transporting the hollow blank 1, which is thus lifted and transported to its turnover position. The finish-rolled hollow blank 1 is then laterally ejected via a pivotable lever 8.

The invention is not limited by the embodiments described above which are presented as examples only but can be modified in various ways within the scope of protection defined by the appended patent claims.

We claim:

1. A device for guiding a hollow blank rotated about a longitudinal axis emerging from a cross-rolling mill in a delivery direction and a delivery plane, the guide device comprising:

a frame; and at least two tubular guide rollers dimensioned so as to extend over an entire length of the hollow blank, the at least two tubular guide rollers being arranged next to each other, below the delivery plane and parallel to the delivery direction of the hollow blank; and means for mounting the at least two tubular guide rollers in the frame so as to be rotatable about their longitudinal axes.

2. The guide device in accordance with claim 1, wherein the means for mounting the at least two tubular guide rollers includes at least two radial bearings, each of the at least two tubular guide rollers being rotatably mounted on a respective one of the radial bearings.

3. The device in accordance with claim 1, and further comprising a plurality of lower support rollers rotatably mounted in the frame, below the at least two tubular guide rollers so as to support the at least two tubular guide rollers.

4. The device in accordance with claim 3, further including means for driving the plurality of lower support rollers, the means for driving the plurality of lower support rollers being synchronized with a delivery speed of the hollow blank.

5. The device in accordance with claim 1, and further comprising means for driving the at least two tubular guide rollers, the means for driving the at least two tubular guide rollers being synchronized with a delivery speed of the hollow blank.

6. The device in accordance with claim 1, wherein the at least two tubular guide rollers are arranged on opposite sides of a vertical plane bisecting the hollow blank so as to be below the longitudinal axis of the hollow blank, the at least two tubular guide rollers being offset by an angle of approximately 30° relative to the horizontal delivery plane.

7. The device in accordance with claim 1, and further comprising at least two inclined guide blocks slidably mounted on the frame, each of the at least two tubular guide rollers being respectively mounted on one of the guide blocks so as to be positionally adjustable to accommodate different dimensions of the hollow blank, each of the inclined guide blocks being arranged symmetrically relative to a center of the respective roll.

8. The device in accordance with claim 1, wherein the at least two tubular guide rollers are jointly pivotable around a central rotational point, so as to adjust the position of the tubular guide rollers to accommodate different dimensions of the hollow blank.

9. The device in accordance with claim 1, and further comprising:

a plurality of upper guide rollers arranged vertically above the hollow blank so as to tangentially contact an outer surface of the hollow blank, the plurality of upper guide rollers being pivotable so as to permit ejection of the hollow blank.

10. The device in accordance with claim 1, and further comprising at least one disk-type roller is arranged between the at least two tubular guide rollers, the at least one disk-type roller being raiseable and lowerable for transporting away the hollow blank, the at least one disk-type roller being rotatable about an axis that runs horizontally and at a right angle relative to the hollow blank delivery direction.

11. The device in accordance with claim 9, wherein each of the plurality of upper guide rollers has a length which is less than the length of the at least two tubular guide rollers.

12. The device in accordance with claim 9, and further comprising means for pivoting the plurality of upper guide rollers.

13. The device in accordance with claim 12, wherein the means for pivoting the plurality of upper guide rollers includes a lever arm and a piston, the lever arm being pivotably mounted to the frame and the lever arm being mounted between the piston and the plurality of upper guide rollers.

14. The device in accordance with claim 10, further including means for raising and lowering the at least one disk-type roller.

15. The device in accordance with claim 14, wherein the means for raising and lowering the at least one disk-type roller includes a lever pivotably mounted to the frame.

* * * * *